US010654677B2

(12) United States Patent
Lucas et al.

(10) Patent No.: US 10,654,677 B2
(45) Date of Patent: May 19, 2020

(54) TRAVERSE WINDING APPARATUS

(71) Applicant: Web Industries, Inc., Marlborough, MA (US)

(72) Inventors: Thomas R. Lucas, Fort Wayne, IN (US); Jules B. Pequignot, Fort Wayne, IN (US)

(73) Assignee: Web Industries, Inc., Marlborough, FL (US)

( * ) Notice: Subject to any disclaimer, the term of this patent is extended or adjusted under 35 U.S.C. 154(b) by 0 days.

(21) Appl. No.: 16/539,743

(22) Filed: Aug. 13, 2019

(65) Prior Publication Data

US 2020/0048023 A1 Feb. 13, 2020

Related U.S. Application Data

(60) Provisional application No. 62/718,265, filed on Aug. 13, 2018.

(51) Int. Cl.

| | |
|---|---|
| ***B65H 23/198*** | (2006.01) |
| ***B65H 18/16*** | (2006.01) |
| ***B65H 23/04*** | (2006.01) |
| ***B65H 23/195*** | (2006.01) |
| ***B65H 19/22*** | (2006.01) |
| ***B65H 19/30*** | (2006.01) |
| ***B65H 18/02*** | (2006.01) |
| ***B65H 54/28*** | (2006.01) |

(52) U.S. Cl.

CPC ..... *B65H 23/198* (2013.01); *B65H 18/021* (2013.01); *B65H 18/028* (2013.01); *B65H 18/16* (2013.01); *B65H 19/2253* (2013.01); *B65H 19/2284* (2013.01); *B65H 19/30* (2013.01); *B65H 23/044* (2013.01); *B65H 23/1955* (2013.01); *B65H 54/2803* (2013.01); *B65H 2301/414321* (2013.01); *B65H 2701/37* (2013.01)

(58) Field of Classification Search

CPC ..... B65H 23/1955; B65H 23/198; B65H 23/2253; B65H 23/2284; B65H 18/021; B65H 18/028; B65H 18/16; B65H 54/2803; B65H 2301/414321; B65H 2701/37

See application file for complete search history.

(56) References Cited

U.S. PATENT DOCUMENTS

| | | | |
|---|---|---|---|
| 3,298,624 | A | 1/1967 | Schott |
| 4,266,735 | A | 5/1981 | Leanna et al. |
| 4,541,583 | A | 9/1985 | Forman et al. |
| 4,621,777 | A | 11/1986 | O'Connor |
| 4,634,069 | A | 1/1987 | Kataoka |
| 4,697,755 | A | 10/1987 | Katoaka |
| 4,948,060 | A | 8/1990 | Kurz et al. |

(Continued)

FOREIGN PATENT DOCUMENTS

| | | | |
|---|---|---|---|
| DE | 19807420 | A1 | 9/1999 |
| EP | 0147123 | A2 | 7/1985 |

(Continued)

OTHER PUBLICATIONS

International Search Report and Written Opinion for PCT/US2019/046379, the International equivalent to the instant pending US Patent Application, dated Dec. 10, 2019.

*Primary Examiner* — William E Dondero

(74) *Attorney, Agent, or Firm* — IP&L Solutions; Edward K Welch, II

(57) ABSTRACT

An improved winding apparatus and system for winding strips of web materials.

31 Claims, 6 Drawing Sheets

(56) References Cited

U.S. PATENT DOCUMENTS

| | | | |
|---|---|---|---|
| 5,909,856 | A | 6/1999 | Myer et al. |
| 6,729,572 | B2 | 5/2004 | Baggot et al. |
| 2010/0108797 | A1 | 5/2010 | Hernandez |
| 2017/0327338 | A1 | 11/2017 | Vergentini et al. |

FOREIGN PATENT DOCUMENTS

| | | | |
|---|---|---|---|
| EP | 0155321 | A1 | 9/1985 |
| EP | 3243777 | A1 | 11/2017 |
| JP | 2005119880 | A1 | 5/2005 |

TRAVERSE WINDING APPARATUS

The present application claims the benefit of U.S. Provisional Patent Application No. 62/718,265 filed Aug. 13, 2018, entitled "Traverse Winding Apparatus," the contents of which are hereby incorporated herein by reference in their entirety.

The present application is directed to traverse winding apparatus for the winding of flexible materials in strip form as well as the components of such apparatus

BACKGROUND

Flexible continuous sheet materials, whether they be polymer films, foamed polymer sheets, fabrics, wovens, non-wovens, paper, and the like, as well as multilayered structures of one or more of the foregoing, altogether "webs", are typically manufactured as wide continuous sheets having widths of one meter or less to several meters or more. While certain processes allow for direct consumption of the so formed web sheets, most often the web sheets are wound into large, master rolls of dozens to hundreds of meters in length, one layer directly overlaying the previously wound layer. However, the vast majority of end-use applications for these web materials call for widths that are substantially less than the widths of the master rolls. Accordingly, it is common and a longstanding practice to slit the web materials into a plurality of strips of defined width(s) corresponding to the width(s) needed for a given end-use application.

In addition, certain applications also require lengths of the web materials that are less than those of the master rolls. One process of reducing both the width and the length of the wound web material is to unwind the master roll and rewind the web material on a sturdy, yet cuttable, core element until the desired length of the web material is wound on the core element. This smaller roll is then subject to a cutting process whereby the roll is cut through, i.e., through the web material and the core element, at the desired width(s). Most often, though, particularly where clean edges and/or high quality production as well as consistent widths are needed or desired, the web material is unwound from the master roll, slit into a plurality of strips of the desired width(s), and rewound onto a core element or, more commonly, a plurality of core elements, one for each strip of web material. Depending upon the width of the strip materials, the winding may be a roll winding where one layer is laid directly over the previously wound layer with the diameter of the roll growing with each successive winding. However, roll winding has its limits. Specifically, roll winding is appropriate for strips of widths of 15 cm or more, preferably 30 cm or more. While roll winding can also be used with strips of 10 cm or more or even 5 cm or more, the stability of the so-formed roll of strip web material is poor, especially as the diameter of the roll increases. Consequently, it is necessary to employ reels having side walls or elements as the core element. Strips of web materials having smaller widths, generally those of 15 cm or less, though possibly up to 25 cm, are typically wound on an elongated core element in a traverse winding process where successive windings are laid next to each other along the length of the core element, with or without overlap, until the end of the core element is reached at which point the winding moves in the opposite direction laying a layer of side-by-side strips, again with or without overlap, atop the previously laid layer until the starting point is reached and the process continues until the desired length of web material is attained or the end of the master roll is reached. Notwithstanding the latter comment, it is also known to splice the tail end of one master roll to the lead end of another master roll so that the slitting and rewinding process is continuous and each winding continues until the desired length of strip material is wound. This process is known as a traverse winding and is especially desirable as it allows for the formation of spools of strips of the web material that are much longer than the master rolls and much, much longer than can be attained with roll winding. With traverse wound spools, the end-user can run their manufacturing process much, much longer before needing to replace or switch out an expired spool for a new spool of the strip material. Nevertheless, despite the attributes and benefits of traverse winding, traverse winding adds another layer of complexity and sophistication to the winding apparatus not seen with roll winders.

Generally speaking, there are two methods by which traverse winding of strip materials is achieved, a center winding method and a surface winding method. In the former, a core element is slid on an axel driven by a motor which provides the rotational movement to the core element. These core winder motors are heavy duty and expensive as they require precise control with high torque capability due to the fact that these motors must adjust the speed and torque at which the core is driven to account for the growing weight and diameter of the spool. In this respect, it is to be appreciated that it is not uncommon for traverse wound spools of web materials to attain lengths of up to 30,000 to 50,000 meters, diameters of up to 122 centimeters (48 inches) and spool lengths of 92 centimeters (36 inches) and weights in excess of 50 kgs. Speed and tension control is especially important to achieve proper spooling without wrinkles, folds and misaligned laydowns on the spool as well as ensure that the web does not jump or fall from any of the roller and directional elements in its journey from the slitter to the laydown device. In this respect, it is important to maintain both speed and tension throughout the slitting process irrespective of the dwindling diameter of the master roll and the growing diameter of the spool. Furthermore, even with the best of core winder motors, the core winding process inherently introduces "cinching" in the rolls and an unevenness in the tightness of the strip web material between the inner layers and the outer layers as a result of the high torque, particularly as the spool gets heavier and heavier and the slippage of the wound materials. Additionally, core winding motors are not responsive or sensitive enough to accommodate light tension and make minor adjustments especially as the spools begin to get heavier and heavier. In any event, once the spool is complete, the spool is slid back off the axel and replaced with a new core element. Given the size and weight of the spool, it is oftentimes necessary to employ a lift device, such as a forklift or motorized roll lift, to remove the spool. This process can be slow and tedious resulting in long down times between winding sequences. Additionally, because each winding station must allow for the ingress and egress of a forklift, the overall process requires substantial workspace.

Surface winding, on the other hand, typically employs an axel with the core element slid thereon and secured thereto, wherein the axel extends beyond each end of the core element, with each extended end of the axel adapted to sit in a support cradle in which the axel is freely rotatable about its axis. A power driven roller is biased against the core element with sufficient pressure such that its rotation transfers the opposite rotation to the axel and core element assembly and, as the winding proceeds, the surface of the wound web material. A lay down head for depositing the slit web material is positioned on the opposite side of the axel from the power driven roller and, typically, is in a touch relationship with the core element and the winding. Both the power driven roller and the lay down head are retractable so that they move away from the spool as it grows in diameter while maintaining contact. Unlike the center winder, the motor driving the roller is simpler as it merely needs to maintain its speed of rotation in order for the surface speed of the spool and the draw of the web material to the spool to be held constant: this is so regardless of the diameter of the spool. When the spools are full, the spools are lifted out of the cradle by an appropriate crane-like apparatus. Most conveniently, an overhead rigging system is employed having a plurality of cross-beams each of which as a plurality of pairs of hook elements spaced and aligned so that when the rigging is overhead the spools, the cross-beams are lowered whereby the hooks engage with the ends of the axel and, when the cross-beam is raised the spools are lifted from the cradles. A second set of cross beams having hooks as well may be present, each spaced from a corresponding first set of cross beams except that these hooks carry a clean axel and core assembly. The rigging is moved in a lateral direction so as to center the second set of hooks over the empty cradles. The second set of cross beams is then lowered to set the new axels in place so that winding can be resumed. The rigging then moves beyond the winders so that the spools of web material can be laid on the floor or on appropriate wagons for subsequent storage. Clean axels are added to the hooks of the second set of cross beams awaiting the next switch-out of the spools. Although convenient and allowing for the replacement of multiple winding elements at one time, the rigging superstructure is expensive and bulky and, more importantly, the process area required for this set up is essentially double since the rigging must clear the existing winding units to unload.

Another factor affecting the simplicity, cost and workspace requirement of the winding process is the nature of the traverse winding itself. Specifically, there are two methods for achieving transverse winding: a stationary winder or a stationary laydown. The former requires the least workspace; however, because the laydown head is continuously traversing back and forth across the face of the core element and growing spool, the length of the path of the web material is constantly changing. Consequently, more sophistication is needed in the laydown assembly to accommodate the changing path as well as in the process control system and logic to ensure that the laydown speed and tension remains substantially constant. Any deviation in movement of the strip of web material resulting in an increase in the tension thereof can cause a stretching and, at the extreme, breaking of the strip of web material. Stretching may be permanent and/or may cause the web material to fold upon itself in the lengthwise direction. Depending upon the nature of the web material itself, the fold may be permanent and lead to an out-of-specification product. Conversely, a deviation may result in too little tension or a slack in the web which may result in the strip of web material jumping or sliding off a roller element in the winding system. Alternatively, or in addition, the slack may result in a bunching up or fold across the width of the strip which becomes wound into the spool: again resulting in a defect finished product. Furthermore, this necessitates the shutting down of the slitting and winding operation so that the web materials may be properly placed back on the roller and guide system.

The second method is that where the laydown head and apparatus is stationary and the winding apparatus comprising the drive motors effecting the winding and the winders themselves are set upon a moving carriage or sled assembly whereby the carriage or sled oscillates such that the core element moves back and forth along its length while the lay down head, which is stationary, lays the web material on the core element and growing spool. This apparatus, while preferred, requires a greater capital commitment since the carriage or sled must also carry the drive means for the winding process as well as a much large footprint since the sled must traverse a distance at least as great as the largest core elements to be used.

Despite all of the advances made in the slitting and winding of web materials there is still a need for new and improved systems and apparatus for use in the slitting and winding of web materials, particularly given the competitive nature of the industry and the realization that even minor changes in the cost and efficiency lead to huge savings in light of the volume of materials processed. In particular, there is a need for simpler and less costly apparatus, for apparatus and systems that have less concern or even eliminate downtime and defects arising from poor tension and speed control, for apparatus and systems that have less special requirements, as well as, finally, systems that achieve the foregoing while increasing capacity, efficiency and throughput.

Finally, there is a need for systems that achieve all or substantially all of the foregoing needs while also having far less spatial requirements. Indeed, land costs, construction costs, facilities maintenance, etc., all add to the increasing burden of manufacture and processing. Being able to reduce those needs leads to additional overall cost savings

SUMMARY

According to the present teaching there is provided an apparatus for traverse winding flexible web materials in strip form comprising:

(a) a reciprocating carriage assembly, (b) a core load and unload assembly, (c) a tension controlled drive and lay down assembly, and (d) a control system wherein the reciprocating carriage assembly (a) comprises (a)(1) a stationary base having a length and width corresponding to a major axis and a minor axis, respectively, and an upper surface; (a)(2) a sled having a length and width corresponding to a major axis and a minor axis, respectively, parallel to the major and minor axes of the base, an upper surface, a front surface, a back surface, and an undercarriage, the front and back surfaces corresponding to the faces of the sled along and perpendicular to the minor axis of the sled, said sled set upon the surface of the base and adapted to move in an oscillating or reciprocating motion along the major axis of the base, and (a)(3) a carriage motor assembly, preferably a motor driven linear actuator, most preferably a motor driven oscillating linear actuator, for effecting the movement of the sled along the major axis of the base;

the core load and unload assembly (b) comprises (b)(1) a superstructure mounted on or set upon the upper surface of the sled and adapted to receive and release a rotatable core element, said superstructure comprising or having (b)(2) parallel support railings or arms having upper and lower ends, the lower ends associated with the upper surface of the sled and the upper ends removed from or extending away from the upper surface of the sled, the railings or arms having (b)(3) opposing chuck elements at or near their upper ends for securely, yet releasably, receiving opposing ends of an elongated core element whose axis, when mounted on the chucks, is parallel to the major axis of the sled, said chuck elements allowing for the free rotation of the core element about its axis, said railings or arms adapted to effect a movement of the core element along the minor axis of the sled from a first position intermediate the front and rear surfaces of the sled to a second position at or proximate to the rear surface of the sled, while maintaining the core element axis parallel to the major axis, the first position corresponding to the point at which winding of the flexible web material on the core element begins and the second position corresponding to the point where the core element is released from the chucks and the core element and, in use, the core element with the wound material is released from the core load and unload assembly;

the tension controlled drive and lay down assembly (c) comprises (c)(1) a lay down assembly mounted on or co-stationary with respect to the stationary base forward of and removed from the front surface of the sled comprising a lay down roller element, whose axis is parallel to the major axis of the base, on a pivoting armature biased, in use, to be in contact with or proximate to, preferably biased to or against, the core element or the surface of the flexible web material as it is wound, (c)(2) a drive roller, whose axis is parallel to the major axis of the sled, aligned with and, in use, biased to be in contact with the core element or the surface of the flexible web material on the core element as it is being wound, the drive roller, effecting rotation of the core element through surface contact, and (c)(3) a drive motor for effecting rotation of the drive roller, the drive roller and drive motor being mounted on or set upon the sled intermediate the core element in its first position and the front face of the sled; and the control system comprises one or more sensors associated with the lay down assembly for detecting changes in the tension of the flexible web material and a processor for assessing the changes in the tension of the flexible web material and adjusting the speed of the drive motor to maintain a substantially constant tension in the flexible material. Optionally, though preferably, the apparatus further comprises a plurality of sensors associated with the load and unload assembly and/or the armature of the lay down assembly which are also connected to the processor or individual processors for detecting the need for or timing of the various actuators as well as effecting their activation and the duration or extent thereof to accommodate the growing spool. Alternatively, the processors may be preprogramed to effect the actuators based upon the known factors associated with the winding process such as the winding speed and pattern, the thickness and width of the material being wound, the length of the traverse/core element, etc.

The foregoing single winding apparatus is used in association with a web manufacturing process wherein the web material is manufactured in a continuous strip form of widths of about 30 cm (12 inches) or less, preferably 15 cm (6 inches) or less. Alternatively, the foregoing apparatus is especially devised and desirable for use in association with the slitting of flexible web materials into a plurality of narrow width strips or tapes wherein a plurality of such apparatus are employed concurrently either as stand-alone units or, preferably, as one or more modular units, each comprising a plurality of a core load and unload assemblies and tension controlled drive and lay down assemblies. For example, a stationary base may comprise a plurality of spaced, parallel rails upon which ride (i) a single sled carrying a plurality of load and unload assemblies or (ii) a plurality of axially aligned sleds, each carrying a load and unload assembly, moving concurrently.

The apparatus according to the foregoing and following teachings, as well as variants thereof, as further described below, entail less capital investment, have higher efficiency and less down time, and/or require less workspace than those of the prior art. Additionally, it is to be appreciated that individual elements of the apparatus may be incorporated into existing web slitting and winding systems and apparatus to provide certain of the benefits thereof to those systems and apparatus as well. In following, the present teachings and claims are directed to those elements as well.

DETAILED DESCRIPTION OF THE DRAWINGS

DETAILED DESCRIPTION

Figure 1:
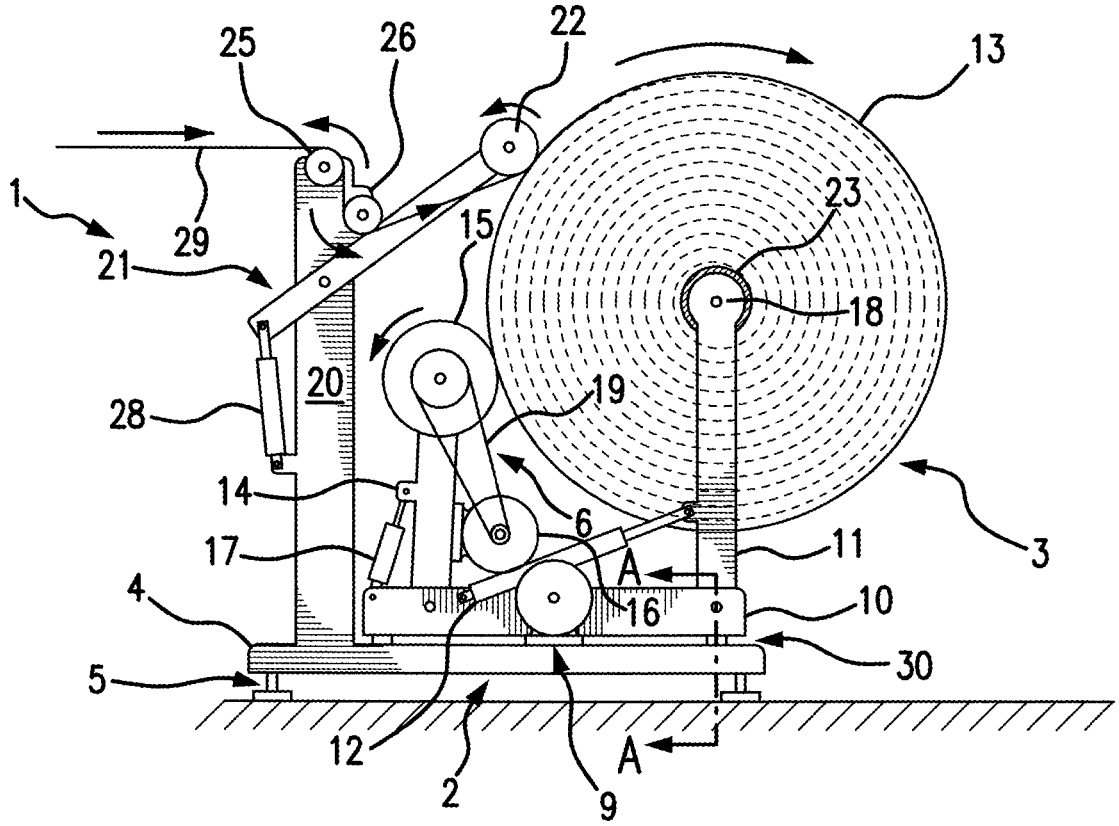
FIG. 1 is a side view of the first embodiment of the winding apparatus of the present teaching.

The present teachings are directed to winding apparatus and components thereof, especially winding apparatus for use in the slitting and winding of web materials. As used herein and the appended claims, the terms "web(s)" and "web material(s)" refers to flexible sheet and strip materials, generally of continuous lengths or lengths in excess of 25 meters, preferably more than 100 meters, composed of polymer or natural materials including, but not limited to, polymer films, foamed polymer films/sheets, natural and synthetic woven fabrics, natural and synthetic non-woven fabrics, gauze, plastic mesh, paper and other cellulosic sheet materials, and the like as well as flexible laminated or composite materials comprising one or more of the foregoing. The present teachings are most especially suitable for use in the winding or slitting and winding of light-weight foamed sheets materials, and woven and non-woven fabrics. Given the nature of traverse winding, the width of the web materials to be wound are generally 30 cm (12 inches) or less, preferably 15 cm (6 inches) or less. Additionally, it is to be appreciated that the use of the term "proximate" in relation to elements of the apparatus means that the position may be before or after the reference point. Hence, when the load and unload apparatus is in the second position, the core element may be positioned above the sled near the back face or over the floor past the back face of the sled.

According to a first embodiment of the present teaching there is provided an apparatus for traverse winding flexible web materials in strip form comprising:

(a) a reciprocating carriage assembly, (b) a core load and unload assembly, (c) a tension controlled drive and lay down assembly, and (d) a control system wherein the reciprocating carriage assembly (a) comprises (a)(1) a stationary base having a length and width corresponding to a major axis and a minor axis, respectively, and an upper surface; (a)(2) a sled having a length and width corresponding to a major axis and a minor axis, respectively, parallel to the major and minor axes of the base, an upper surface, a front surface, a back surface, and an undercarriage, the front and back surfaces corresponding to the faces of the sled along and perpendicular to the minor axis of the sled, said sled set upon the surface of the base and adapted to move in an oscillating or reciprocating motion along the major axis of the base, and (a)(3) a carriage motor assembly, preferably a motor driven linear actuator, most preferably a motor driven oscillating linear actuator, for effecting the movement of the sled along the major axis of the base;

the core load and unload assembly (b) comprising (b)(1) a superstructure mounted on or set upon the upper surface of the sled and adapted to receive and release a rotatable core element, said superstructure comprising or having (b)(2) parallel support railings or arms having upper and lower ends, the lower ends associated with the upper surface of the sled and the upper ends removed from or extending away from the upper surface of the sled, the railings or arms having (b)(3) opposing chuck elements at or near their upper ends for securely, yet releasably, receiving opposing ends of an elongated core element whose axis, when mounted on the chucks, is parallel to the major axis of the sled, said chuck elements allowing for the free rotation of the core element about its axis, said railings or arms adapted to effect a movement of the core element along the minor axis of the sled from a first position intermediate the front and rear surfaces of the sled to a second position at or proximate to the rear surface of the sled, while maintaining the core element axis parallel to the major axis, the first position corresponding to the point at which winding of the flexible web material on the core element begins and the second position corresponding to the point where the core element is released from the chucks and the core element and, in use, the core element with the wound material is released from the core load and unload assembly;

the tension controlled drive and lay down assembly (c) comprises (c)(1) a lay down assembly mounted on or co-stationary with respect to the stationary base forward of and removed from the front surface of the sled comprising a lay down roller element, whose axis is parallel to the major axis of the base, on a pivoting armature biased, in use, to be in contact with or proximate to, preferably biased to or against, the core element or the surface of the flexible web material as it is wound, (c)(2) a drive roller, whose axis is parallel to the major axis of the sled, aligned with and, in use, biased to be in contact with the core element or the surface of the flexible web material on the core element as it is being wound, the drive roller, effecting rotation of the core element through surface contact, and (c)(3) a drive motor for effecting rotation of the drive roller, the drive roller and drive motor being mounted on or set upon the sled intermediate the core element in its first position and the front face of the sled, and the control system comprises one or more sensors associated with the lay down assembly for detecting changes in the tension of the flexible web material and a processor for assessing the changes in the tension of the flexible web material and adjusting the speed of the drive motor to maintain a substantially constant tension in the flexible material. Optionally, though preferably, the apparatus further comprises a plurality of sensors associated with the load and unload assembly and/or the armature of the lay down assembly which are also connected to the processor or individual processors for detecting the need for or timing of the various actuators as well as effecting their activation and the duration or extent thereof to accommodate the growing spool. Alternatively, the processors may be preprogramed to effect the actuators based upon the known factors associated with the winding process such as the winding speed and pattern, the thickness and width of the material being wound, the length of the traverse/core element, etc.

According to a second embodiment there is provided an apparatus for simultaneously traverse winding a plurality of strips of flexible web material, most especially a plurality of such strips arising from the slitting of a master roll of said flexible web material, said apparatus comprising:

(a) a reciprocating carriage assembly,
(b) a plurality of core load and unload assemblies,
(c) a tension controlled drive and lay down assembly associated with each core load and unload assembly, and
(d) a control system wherein the reciprocating carriage assembly (a) comprises (a)(1) a stationary base having a length and width corresponding to a major axis and a minor axis, respectively, and an upper surface; (a)(2) one or more sleds having a length and width corresponding to a major axis and a minor axis, respectively, parallel to the major and minor axes of the base, the or each sled having an upper surface, a front surface, a back surface, and an undercarriage, the front and back surfaces corresponding to the faces of the sled along and perpendicular to the minor axis of the sled, said sled set upon the surface of the base and adapted to move in an oscillating or reciprocating motion along the major axis of the base or, if a plurality of sleds, the sleds linearly aligned along their major axes, preferably spaced, and adapted to move in unison in an oscillating or reciprocating motion along the major axis of the base, and (a)(3) a carriage motor assembly, preferably a motor driven linear actuator, most preferably a motor driven oscillating linear actuator, for effecting the movement of the sled(s) along the major axis of the base;

each core load and unload assembly (b) comprising (b)(1) a superstructure mounted on or set upon the upper surface of the or each, as appropriate, sled and adapted to receive and release a rotatable core element, said superstructure comprising or having (b)(2) parallel support railings or arms having upper and lower ends, the lower ends associated with the upper surface of the sled and the upper ends removed from or extending away from the upper surface of the sled, the railings or arms having (b)(3) opposing chuck elements at or near their upper ends for securely, yet releasably, receiving opposing ends of an elongated core element whose axis, when mounted on the chucks, is parallel to the major axis of the sled, said chuck elements allowing for the free rotation of the core element about its axis, said railings or arms adapted to effect a movement of the core element along the minor axis of the sled(s) from a first position intermediate the front and rear surfaces of the or each sled to a second position at or proximate to the rear surface of the or each sled, while maintaining the core element axis parallel to the major axis, the first position corresponding to the point at which winding of the flexible web material on the core element begins and the second position corresponding to the point where the core element is released from the chucks and the core element and, in use, the core element with the wound material is released from each core load and unload assembly; and the tension controlled drive and lay down assemblies (c) comprise (c)(1) a plurality of lay down assemblies, each mounted on or co-stationary with respect to the stationary base forward of and removed from the front surface of the sled(s), each lay down assembly opposing a core element and comprising a lay down roller element, whose axis is parallel to the major axis of the base, on a pivoting armature biased, in use, to be in contact with or proximate to the opposing core element or the surface of the flexible web material as it is wound on that core element, (c)(2) a plurality of drive rollers, each of whose axis is parallel to the major axis of the sled(s), each drive roller being parallel to and intermediate the opposing core element and the front face of the sled, the drive roller, in use, biased to be in contact with the opposing core element or the surface of the flexible web material on that core element for effecting rotation of that core through surface contact, and (c)(3) a plurality of drive motors, each associated with a drive roller for effecting rotation of that drive roller, and the control system comprising tension sensors associated with each lay down assembly for detecting changes in the tension of the flexible web material passing through that lay down assembly and either (d)(1) a central processor for assessing the changes in the tension of the flexible web material of each lay down assembly and individually adjusting the speed of the drive motor of the respective lay down assembly to maintain a substantially constant tension in the flexible web material passing through each lay down assembly or (d)(2) a plurality of processors, one associated with each lay down assembly and its respective sensors, for adjusting the speed of the drive motor of that lay down assembly to maintain a substantially constant tension in the web material passing through that lay down assembly, most preferably the former. Optionally, though preferably, the apparatus further comprises a plurality of sensors associated with the load and unload assembly and/or the armature of the lay down assembly which are also connected to the aforementioned processor or processors or to additional individual processors for detecting the need for or timing of the various actuators as well as effecting their activation and the duration or extent thereof, most preferably the former, to accommodate the growing spool. Alternatively, the processors may be preprogramed to effect the actuators based upon the known factors associated with the winding process such as the winding speed and pattern, the thickness and width of the material being wound, the length of the traverse/core element, etc.

According to a third embodiment there is provided an apparatus for simultaneously traverse winding a plurality of strips of flexible web material, most especially a plurality of such strips arising from the slitting of a master roll of said flexible web material, said apparatus comprising either (A) a plurality of reciprocating carriage assemblies each having associated therewith a core load and unload assembly and a tension controlled drive and lay down assembly according to the first embodiment or (B) a plurality of carriage assemblies each having associated therewith a plurality of load and unload assemblies and tension controlled and lay down assemblies according to the second embodiment.

According to a fourth embodiment of the present teaching there is provided a load and unload assembly for use with or incorporation into a web material winding apparatus said load and unload assembly comprising a superstructure to be mounted on or set upon a support frame having an access side and adapted to receive and release a rotatable core element, said superstructure comprising or having parallel support railings or arms having upper and lower ends, the lower ends associated with the support frame and the upper ends removed from or extending away from the support frame, the railings or arms having opposing chuck elements at or near their upper ends for securely, yet releasably, receiving opposing ends of an elongated core element, said chuck elements allowing for the free rotation of the core element about its axis, said railings or arms adapted to effect a movement of the core element along a pathway perpendicular to the axis of the core element, from a first position over the support frame and corresponding to the point at which winding of the flexible web material on the core element begins and to a second position at or proximate to the access side thereof and corresponding to the point where the core element is released from the chucks. Preferably, the superstructure further comprises a base to which the support railings or arms are attached and from which they extend, which base may be stationary or adapted to move along a path perpendicular to the axis of the core elements from the first position to a second position, which movement is in addition to the aforementioned movement of the core element.

The Reciprocating Carriage Assembly

The first key component of the winding assemblies of embodiments one through three is the reciprocating carriage assembly (a) comprising (a)(1) the stationary base, (a)(2) the one or more sleds, and (a)(3) the carriage motor assembly for effecting the reciprocation or oscillation of the sleds on the stationary base.

The stationary base serves as a structure upon which the sled or sleds reciprocate or oscillate. In its simplest of form, the base may be a platform that provides a flat surface across which the sleds are able to reciprocate. Alternatively, the base may be a pair of spaced, parallel rails, either secured to the floor or to the upper surface of a frame or platform, which is preferably secured to the floor or it may simply comprise a platform having a deck or upper surface of sufficient durability and strength to support one or more sleds as they traverse across the surface thereof. The base generally occupies a rectangular space having a length and width, the length corresponding to the major axis of the base and the width corresponding to the minor axis. The rails or tracks along which the sleds move align with and are parallel to the major axis and are of suitable length to accommodate the movement of the sled or sleds during the traverse winding process.

The sled is a frame or platform, generally rectangular in shape, having a width, corresponding to its minor axis, and a length, corresponding to its major axis, both of which are sized to be suitable for carrying the load and unload assembly for the size of the winding to be performed. The sled has a surface upon which the load and unload assembly is situated, a front face and a rear face, these faces corresponding to that surface of the sled along and perpendicular to the minor axis thereof, and an undercarriage which, preferably, includes the elements upon which the sled rides.

These elements may be rollers, wheels, rotating bearings, or the like. The undercarriage and/or the opposing end faces of the sled, i.e., those faces along and perpendicular to the major axis of the sled, has or is associated with one or more elements which engage, directly or indirectly, the carriage motor assembly whereby movement of the sled is effected. For example, a "nut" may be associated with the sled which engages a screw-type element of the carriage motor assembly.

The last component of the reciprocating carriage assembly is the carriage motor assembly comprising a motor and a drive, whose operation is effected by the motor, wherein the drive is either connected to or adapted to interact and effect movement of the sled along the base and rails. Like the base, the carriage motor assembly may be secured to the floor or to a frame or platform, which may be the same or different form the frame or platform upon which the rails sit, if any, or it may be integrated into or affixed to the base itself. Those skilled in the art will readily appreciate the variety and nature of suitable motor and drive means and devices for effecting the reciprocating or oscillating motion of the sled along the major axis of the base. Preferably, the carriage motor assembly is an electro-mechanical actuator, more preferably an electro-mechanical linear actuator, most preferably an electro-mechanical oscillating linear actuator. Exemplary linear actuators include screw actuators, such leadscrew, screw jack, ball screw, or roller screw actuators as well as wheel and axel actuators, rack and pinion, chain drive, belt drive, rigid chain and rigid belt actuators. For example, the drive may be a motor driven cog and orbiting chain assembly, the latter of which is connected to or imparts movement to the sled. Alternatively, the drive may be a ball or nut screw assembly where the screw, more appropriately the lead screw, is integrated into or associated with the base and stationary, but for rotation, with respect thereto, and the ball or nut is integrated into or associated with the sled such that as the lead screw rotates, the ball or nut effects a movement of the sled along the screw.

Core Load and Unload Assembly

The core load and unload assembly (b) comprises a superstructure mounted on or set upon the upper surface of the sled and adapted to receive and release a rotatable core element. The superstructure preferably comprises either a pair of spaced, parallel support railings or a pair of spaced arms, each railing or arm i) being secured to or associated with the upper surface of the sled and extending away therefrom and ending in a free end, ii) being spaced relative to each other along the major axis and at a distance such that a core element is capable of being held between the two with the axis of the core element parallel with the major axis of the sled, and iii) having associated with its free end a core securing element, preferably a chuck or like element, especially a R/L ball screw type chuck element, for securely holding the core element upon which the web material is to be wound. Finally, the railings and arms are adapted to facilitate or effect a movement of the core element held in the chucks back and forth between a first position intermediate the front and rear surfaces of the sled, preferably intermediate the front surface and the midpoint of the width of the sled, to a second position at or proximate to the rear surface of the sled. The first positions generally corresponds to that point along the path of movement of the core element where the winding of the web material on the core element is performed or initiated and the second point corresponds to that point along the path of movement where the core element is released from the core load and unload assembly. The adaptation of the railings and arms to effect said movement comprises an actuator associated with at least one, preferably an actuator associated with each, railing or arm for enabling the movement of the core element along the aforementioned path.

Support Railings

The support railings comprise a plurality of vertical rail elements, whose lower ends are secured to or associated with the upper surface of the sled and whose upper ends support an upper horizontal or substantially horizontal rail. The plane of the railings, which is generally defined by the vertical and horizontal rails, is perpendicular to the major axis of the sled. The upper horizontal rail is adapted to allow the chuck to move back and forth along the upper horizontal rail from a first position intermediate the front and rear surfaces of the sled, preferably intermediate the front surface and the midpoint of the width of the sled, where the winding is initiated, to a second position at or proximate to the rear surface of the sled where the core element is released from the core load and unload assembly. Generally speaking, the first and second positions of the chuck along the upper rail correspond to the front end and the rear end, respectively, of the upper rail element. Preferably the upper rail is or is associated with a track along which the chuck, or a sled, slide or other carrier element to which the chuck is securely attached, rides. Finally, as noted, the upper rails need not be truly horizontal. Indeed, it is desirable that the upper rails have a moderate to gentle slope, generally 45° or less, preferably 35° or less, more preferably 20° or less, in a downward direction, i.e., towards the surface of the sled, from the front end to the rear end of the rail.

Although the movement of the chucks along the upper rail element may be effected manually, it is preferably brought about by use of a first actuator mounted on or associated with the railing, preferably a pair of first actuators, one associated with each railing. Operation of the actuator, hence movement of the chuck and core element, may be continuous, step-wise or a combination thereof. For example, there may be a step-wise movement from the first position to an intermediate position as the winding progresses and, once the winding is completed, continuously from the intermediate position to the second position.

The support railings may also have associated therewith a second actuator which causes one or both railings or that portion of the railing(s) at or near the rear end of the upper rail, particularly the rear end of the upper rail, to move away from each other so as to allow the core element to be released from the chucks. For example, the lower end of one or both railings may be hinged so that the second actuator(s) cause or allow the plane(s) of the railing(s) to tilt away from one another. Alternatively, the rear planar portion of one or both railings may be hinged, like a door, to the remainder of the railing such that the second actuator causes that portion to swing away from the other railing. Finally, yet another alternative, one which does not require the use of a second actuator, is where that portion of the upper rail or the track associated therewith at or near the rear end of the upper rail veers away from the linear axis of the rail, generally along the plane defined by the upper rails of each set of railings in the direction opposite the other railing. In this way, the core element is released as the chuck elements separate from one another as they ride along the rear end of the track.

Pivoting Arms

Alternatively, the superstructure may comprise a pair of spaced arms, especially arms that pivot in at least the direction of the minor axis of the sled. The lower end of each arm is secured to or associated with the upper surface of the sled and the upper ends extend away from the surface of the sled and end with a chuck or chuck assembly at a point above the upper surface of the sled. The arms are aligned along the major axis of the sled and are spaced so as to securely hold a core element in the chucks of the opposing arms. The design and construction of the arms is not critical so long as they are able to support the weight of the fully loaded core elements. However, the arms are adapted to pivot about or from their lower ends along the minor axis of the sled such that the upper ends, especially the chucks, are able to move back and forth along or parallel to the minor axis from a first position intermediate the front and rear surfaces of the sled, preferably intermediate the front surface and the midpoint of the width of the sled, where the winding is initiated, to a second position at or proximate to the rear surface of the sled where the core element is released from the core load and unload assembly. As with the railings, while movement of the arms may be effected manually, it is preferably brought about by an actuator, most preferably a pair of actuators, one associated with and acting upon one arm and the other associated with and acting upon the other. Again, operation of the actuator, hence movement of the chuck and core element, may be continuous, step-wise or a combination thereof. For example, there may be a step-wise movement from the first position to an intermediate position as the winding progresses and, once the winding is completed, continuously from the intermediate position to the second position.

Optionally, though preferably, the arms are also adapted to pivot away from one another such that the distance between the chucks increases so as to release the core element. This movement may be associated with the pivoting movement of the arms as the ends thereof approach the second position or may be initiated after the ends are already at the second position. Preferably this second motion is the result of the action of a second actuator associated with and acting upon at least one of the arms, most preferably a pair of second actuators, one acting upon each arm. These second actuators generally cause a movement of the upper ends of the arm along the direction of the major axis of the sled. To accommodate this action, the lower ends of the arms may have a second pivot point or the pivot point that allows for initial movement noted above may be a universal joint allowing 360° movement.

Actuators

The first and second actuators of the load and unload assemblies may be of any type suitable for effecting the movement(s) described, whether for the railings or the arms. Preferably, the actuators are linear actuators, including electro-mechanical actuators of the type described above for the movement of the carriage assembly. More preferably, the first and second actuators are pneumatic or hydraulic actuators. In the case of the railings, the first actuator(s) will be fixed, at one end, to the railing and the opposing end will be fixed to and/or interact with the chuck or, if present, the sled or carriage element for the chuck. The second actuator(s) will be fixed at one end to the upper surface of the sled with the opposing end fixed to the railing intermediate the lower and upper ends or, in the case the railing has a door-like section as its end, fixed at one end to the major portion of the railing and at the other end to the hinged portion of the railing. In the case of the arms, the first and second actuators will typically be fixed to the surface of the sled at one end and to a point intermediate the lower ends and the upper ends at the other end with the planes containing the actuators and the arms intersecting one another in a perpendicular or substantially perpendicular manner.

Chucks

The final required element of the load and unload assembly are the chucks. As noted above, the chucks are seated at or near the ends of the arms or on or are integrated into a sled-like element that runs along the track of the upper horizontal rail in the case of the railings. The chucks have a protruding element that engages and secures the core element in place and allows for the free rotation of the core element about its axis. Optionally, the chucks may have associated therewith a brake and/or drive mechanism that helps slow or rotate, respectively, the core element: though neither is necessary nor, in the interest of simplicity and minimal expense, desirable. Additionally, the chucks may be designed whereby the protruding element is capable of extending and retracting so as to engage and disengage from the core element. Such an assembly will employ yet another linear actuator, preferably a hydraulic or pneumatic actuator.

Superstructure Base

Optionally, the superstructure may further comprise a base, frame of like platform which is situated upon the upper surface of the sled and to which the lower ends of the railings or arms, as appropriate are affixed. One purpose of this base is to present the superstructure as a single, preferably modular, unit which can be readily attached to and removed from the sled. Hence, the base will have at least one cross-beam or cross-element securing one arm or railing to the other. In the event the base is present, the actuators that are otherwise said to be affixed to or associated with the upper surface of the sled will instead be affixed to the upper surface of the base.

Preferably, if the base is present, the base is such that it is moveable or capable of being slid across the upper surface of the sled along the minor axis from an initial position corresponding to that position when the arms are in their first position to an ending position closer to the rear face of the sled. In this manner, when the core element is in its release position, it is positioned over the floor past the rear face of the sled and, most preferably, past the rear face of the carriage assembly. Furthermore, and preferably, in operation one may position a dolly or cart alongside the load and unload assembly so that when the core element is released from the chucks, the core element and the web material wound thereon falls into the dolly or cart for easy transport.

Tension Controlled Drive and Laydown Assembly

The tension controlled drive and lay down assembly (c) comprises a lay down assembly, a drive roller, and a drive motor for effecting rotation of the drive roller.

The lay down assembly comprises a lay down roller element whose rotational axis is parallel to the major axis of the base and which is mounted on a pivoting armature biasing the lay down roller to be in contact with or proximate to the core element or, as appropriate, the surface of the web material as it is being wound. Preferably, the lay down roller is biased against the core element and winding so that it is able to smooth out the web material and press out any air that may be trapped as the web material is being wound. Most preferably, the biasing means is such that it allows the laydown roller to move away from the core element as the diameter of the wound material grows, while maintaining a tension against the same.

The pivoting armature is attached, directly or indirectly, to a frame, preferably a stand element, that is seated on and preferably fixed to the floor or to the carriage assembly at a location opposite the front face of the sled and one of the chucks, most preferably opposite one end of the core element when in place. The pivoting armature is biased by means of a tensioning element such as a spring or plurality of springs and/or the use of an actuator, especially a hydraulic or pneumatic actuator, attached at one end to the stand and the other to the pivoting armature. Furthermore, as will be discussed below, the armature may be associated with one or more sensor elements that sense the positioning of the armature relative to the stand and/or the force of the growing winding against the lay down roller whereby once a particular position or setting or back force is reached, the actuator moves the armature so as to move the lay down roller away from the winding.

The lay down roller will typically have a diameter of from about 5 cm to about 20 cm, more preferably from about 10 cm to about 15 cm, and a length that is at least as wide as the width of the strip of web material being wound, preferably 1.5× to 5× the width of the web material. Rotation of the lay down roller is free-based whereby rotation is effected by the movement of the web material and/or the rotation of the core element.

In addition to the lay down roller, there may be additional positioning or idle rollers associated with the armature for providing a pathway for the web material from the feed to the lay down roller and stabilizing the same so that the web meets the laydown roller perpendicular to the axis of the lay down roller. The diameter of the positioning rollers is typically from about 5 cm to about 7.5 cm with a length that is at least as wide as the width of the strip of web material being wound, preferably 1.5× to 3× the width of the web material. The positioning rollers may also be contoured or shaped to restrict lateral movement of the web material across the length of the positioning rollers. Preferably, the positioning rollers have axes that are parallel to the axis of the lay down roller.

The second major assembly of the tension controlled drive and lay down assembly is the drive roller and drive motor assembly which, as a whole, is positioned between the front face of the sled and the core element or chucks. The drive roller is positioned to have its axis parallel to the axis of the core element and be in contact, preferably firm contact, with the core element. The drive roller typically has a diameter of from about 10 cm to about 30 cm, more preferably from about 10 cm to about 20, most preferably about 15 cm, and a length that is typically the same as or slightly wider than the length of the core elements to be employed with the apparatus. Shorter drive rollers are possible; however, it is preferable to have the drive roller press against the surface across the entire width of the spool as it grows to further smooth out the surface of the spooled materials and, more importantly, enhance the efficiency of the rotation transfer from the roller to the spool.

The positioning of the drive roller is typically accomplished by a pair of spaced pivoting drive arms where the drive arms are capable of pivoting along the minor axis of the sled. The arms are fixed to the upper surface of the sled at their lower end and extend in the general direction of the core element. The drive arms end with a hub assembly which acts as a seat and attachment point for the drive roller. The hub assembly may comprise chucks which engage the ends of the drive roller or, more preferably, a seat and engagement point for an axel that is integrated into or which passes through the drive roller. Depending upon the orientation and nature of the drive motor assembly, the hub assembly may also comprise elements by which the rotary motion of the motor is transferred to the drive roller. For example, the hub assembly may have a flywheel, gear or other like element that engages belt, gear or other element associated with the drive motor.

Like the arms of the load and unload assembly, the drive arms also have associated therewith an actuator or a pair of actuators, one associated with each arm, attached at one end to the upper surface of the sled and at the other end to a point intermediate, preferably the midpoint, along the length of the arms. The actuators are preferably linear actuators, most preferably an electro-mechanical screw-type actuator, a pneumatic actuator or a hydraulic actuator. The actuators maintain the drive roller biased against the core element and the growing winding with sufficient force to enable an efficient transfer of rotation from the drive roller to the core element and growing winding. Optionally, the drive roller and drive motor assembly will have one or more sensors associated therewith to detect the extent of the force against the drive roller caused by the growing winding which triggers the actuators to pivot the drive arms in order to back the drive roller away from the winding, though still maintaining proper and sufficient contact. Alternatively, the actuators may be connected to a central control system, as discussed below, whereby other detectors associated with the winding apparatus detect the growth of the winding and effect the movement of the drive roller, most preferably concurrent with the pivoting of the arms of the load and unload assembly. Still further, as discussed elsewhere, the processor may be preprogrammed to automatically back the drive arms from the spool when certain winding milestones are met.

The final element of the driver roller and drive motor assembly is the drive motor itself. The drive motor is an electric motor that directly or indirectly effects the rotation of the drive roller. Most preferably the drive motor indirectly effects rotation of the drive roller. Specifically, a band, belt, chain or gear box engages the drive train of the motor as well as the axel or one of the chucks of the drive roller whereby the rotation of the motor is transferred to the drive roller. While the drive motor may be positioned on the upper surface of the sled, in order to maintain the tension in the belt, band or chain while the drive arms pivot, the drive motor is preferably mounted on one of the drive arms.

Control System

The final component of the disclosed apparatus is the control system comprising tension sensors associated with the lay down assembly for detecting changes in the tension of the web material and a processor for assessing the changes in the tension of the web material and adjusting the speed of the drive motor to maintain a substantially constant tension in the web material. These sensors may operate intermittently, e.g., every 5, 10, 30 or so seconds, or continuously with continual or real-time readings so that adjustments can be promptly made to the speed of the drive rollers and, in turn, the winding.

Optionally, though preferably, the control system further comprises sensors associated with the winding operation, for example detecting the growing diameter of the winding and/or forces against the lay down roller and/or the drive roller whereby the signals from the sensors are processed by the processor to activate the appropriate actuators association with the drive assembly and/or the load and unload assembly. Alternatively, or in addition, the processor may be programmed to automatically activate the various actuators based upon certain length milestones attained during the winding process, said milestones accounting for the thickness of the materials being wound, the width of the strips of web material, the winding pattern, and the like. Additionally, the processor may be manually controlled by a system operator to interrupt or initiate and/or control any activity or function of the overall apparatus as needed, for example, if a strip of web material should break or the master roll reaches its end without a new roll being available, etc.

The apparatus as described above may be employed as a single stand-alone unit, for example, as a winding component of a manufacturing process that manufactures a single strip of a web material. Preferably, however, the apparatus is employed in conjunction with the slitting of web materials from master rolls or from manufacturing processes where the web material is produced as a wide continuous sheet wherein the web material is slit into a plurality, oftentimes a large plurality, of strips. In these instances, either a plurality of the overall apparatus as first described above are employed or, preferably, a single or plurality of carriage assemblies are employed, each having a plurality of sleds and associated components. In these latter instances, each carriage will have two to six sleds associated therewith, more preferably three or four sleds. Where more winding assemblies are needed, from a spatial standpoint it is desirable to situate or position a plurality of carriage assemblies, each with a plurality of sleds, parallel to one another in a side by side relationship, though spaced sufficiently to allow workers to pass there between and to allow the unloading and transport of the fully wound spools as they are unloaded from the load and unload assembly.

Another advantage of the design and operation of the instant apparatus is the ability to wind larger spools than have previously been wound. While the winding of traditional sized spools of web material, as mentioned in the background, are certainly enabled, the present apparatus is also able to wind spools of about 152 centimeters (60 inches) or more in diameter and 127 centimeters (50 inches) in length, resulting in spools on which the length of the web material is as much as 2.5× (or more) that of conventional spools.

Perhaps the most advantageous embodiment of the present teaching is that where a plurality of sleds are on a single carriage assembly, most preferably a plurality of sleds on a plurality of carriages, e.g., where 8 carriages have 3 or 4 sleds each, or more. In these instances, each carriage assembly has a single carriage motor which drives a single linear actuator, for simultaneously moving each of the sleds on a given carriage base or platform. Additionally, it is preferred that the drive assembly be a part of or integrated into the carriage base assembly rather than be part of the sled itself. Here, the carriage motor will most preferably operate a screw element of a linear actuator that has a plurality of nuts associated therewith, each with a defined reciprocating path, which nuts correspond to the positioning of the sleds whereby all sleds move concurrently along the major axis of the base. Additionally, it is preferred that a single processor be associated with all sleds on a given carriage assembly; though a single processor may control all winding assemblies and sleds or there may be a single master processor to which each of the processors associated with the individual carriage assemblies is connected.

What is most beneficial of these latter embodiments is that the footprint or special requirements needed for this system or configuration is minimal in comparison to traditional core winding and surface winding systems. Indeed, because the paths of adjacent sleds on a given carriage substantially overlap with each other, much less floor space is needed to accommodate the larger number of winders and, hence, that amount of floor space is able to produce an output that is multifold greater than capable with other systems. Additionally, while traditional surface winding systems can be placed closer to one another, they still require adequate spacing for personnel to walk between the rows of winders and be able to work on them as well as repair them. More importantly, since traditional surface winders use a crane-type superstructure to lift the spools from the cradles, those systems require a footprint that is at least double the footprint of the winding area alone. The presently taught system only requires a fraction of that space since this system only requires sufficient room between the carriage assemblies to allow for the spools to be removed and transported to the storage area.

Having described the overall apparatus and its elements and their general alignment and function, attention is now directed to the drawings depicting specific embodiments and the operation of the apparatus set forth in those drawings.

Figure 2A:
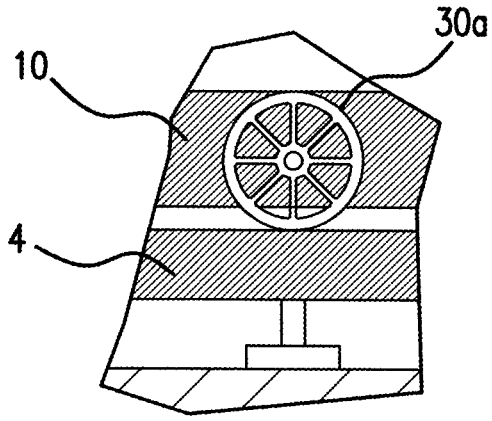
FIGS. 2A and 2B are cross-sectional views of alternate versions of that portion of the apparatus of FIG. 1 defined by line A-A.
Figure 2B:
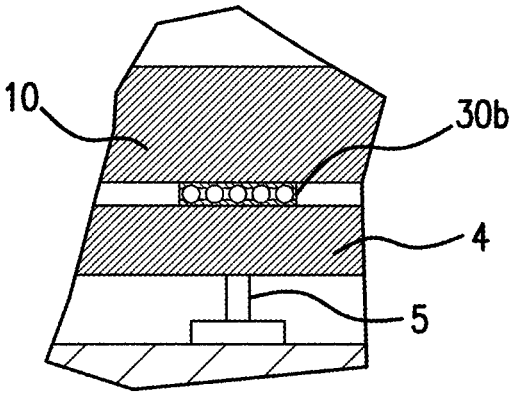

FIG. 1 depicts a side view of a single winding apparatus 1 according to the present teaching. As shown, the carriage assembly 2 comprising the base 4, the sled 10 and the carriage motor assembly 9 is secured to the floor by footings 5. The sled is capable of movement along the surface of the base along an axis perpendicular to the plane of the figure, driven by motor assembly 9, which, like the sled, sits atop the base except that it is fixed to the base. Movement of the sled is facilitate by a plurality of wheels 30*a* or bearings 30*b* on the underside 30 of the sled as shown in FIGS. 2A and 2B which presents a cross-sectional view of the corner of the sled of FIG. 1 along line A-A.

Situated atop the sled 10 is the load and unload assembly 3 and the drive motor and drive roller assembly 6. In this particular embodiment, the superstructure of the load and unload assembly comprises a pair of pivoting spool support arms 11 which are pivotingly affixed at their lower end to the upper surface of the base. Each spool support arm extends away from the surface of the sled and ends with a chuck 18: the opposing chucks holding in place a core element 23. The pivoting action of the spool support arms is effected by pair of spool support actuators 12 fixed at one end to the sled and at the other to the opposing arms 11. Movement of the spool support arms is shown in the sequence of drawings presented in FIGS. 3A, 3B and 3C, as described further below.

The drive motor and drive roller assembly 6 comprises a pair of drive support arms 14 one of which has mounted thereon a dive motor 16 and a drive roller 15, the rotation of the drive motor transferred to the drive roller by belt 19. The other drive support arm supports the other end of the drive roller. The drive support arms also have associated therewith a pair of drive actuators 17, one associated with each drive support arm, which bias the drive roller to the spool 13 of the winding as well as backs or allows the backing away of the drive roller away from its initial position as the spool grows in diameter. Although a single drive actuator could be used, it is preferable to have two to provide an even force against the spool along the whole length of the drive roller 15.

Also sitting atop and integrated into the base is a stand 20 associated with the lay down apparatus 21 which lay down apparatus comprises a pivoting lay down arm 27 pivotingly affixed to the stand and a laydown roller 22, the latter positions at the end of the lay down arm away from the stand towards the load and unload assembly. The lay down roller is preferably in a touch relationship with the spool and is biased that way by a lay down actuator 28 which is affixed at one end to the stand and at the other to the pivoting arm. Also associated with the stand is a tension sensing roller 25 and an idler roller 26 defining the path for the web material 29 from the source, which may be a slitter or a driven roller assembly which helps feed the web to the winding apparatus, to the lay down roller. Additionally, the tension sensing roller detects changes in the tension of the web material which information is transmitted to a processor (not shown) which, in turn, makes adjustments to the speed of the drive motor in an effort to maintain a constant tension throughout the winding process.

Figure 3A:
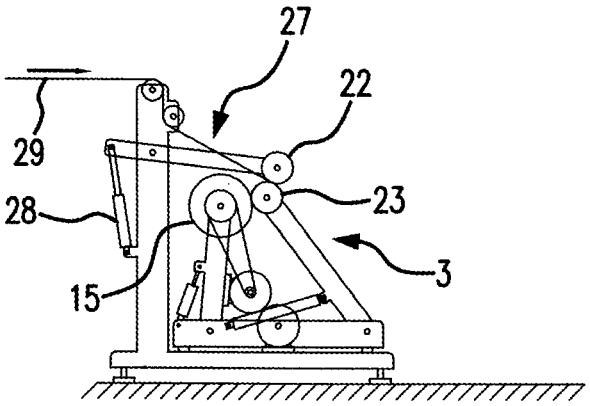
FIGS. 3A, 3B and 3C are sequential side views of the apparatus of FIG. 1 during operation.
Figure 3B:
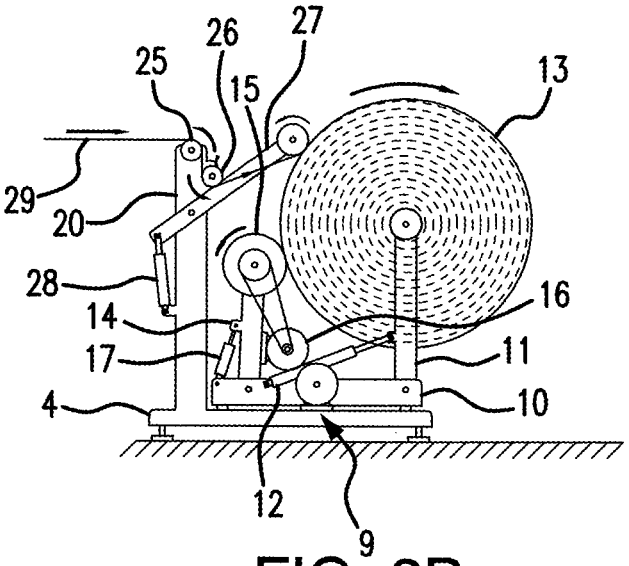
Figure 3C:
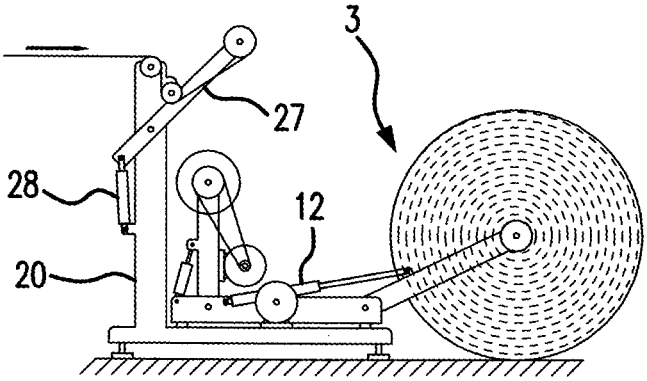

FIGS. 3A, 3B and 3C depict the apparatus of FIG. 1 in three stages of the winding process. In FIG. 3A, the load and unload assembly 3 is in its first position with the lay down roller 22 in contact with the core element 23 to which the lead end of the web material 29 has been affixed. Similarly, as shown, the drive roller 15 is likewise in contact with the core element. At this point, in this particular embodiment, the lay down actuator 28 and the drive actuator(s) 17 are in an extend state whereas and the support arm actuator(s) 12 are in a retracted state.

FIG. 3B presents an intermediate position where the winding of the web material on the spool 13 is complete or nearly complete. As evident from the drawings, the support arms 11 of the load and unload assembly have pivoted away from the stand 20 through the action of the support arm actuators 12. Concurrently, to accommodate the growth in the diameter of the spool, the lay down actuator 28 and the drive actuator(s) 17 have retracted somewhat: enough to address the diameter of the spool while concurrently maintaining the proper bias against the surface of the spooled web materials. Movement or pivoting of the support arms 11 from the first position to the intermediate position is controlled by a processor and sensors (not shown), the latter of which detects the growing diameter of the spool and sends signals to the processor which, in turn signals the support arm actuators to extend. This movement may be gradual, as in a continuous monitoring and adjustment operation, or stepped whereby adjustments are made at predetermined points in the winding process.

Finally, FIG. 3C presents the second position of the load and unload assembly 3 wherein the support arm actuators 12 are fully extended whereby the spool 13 of web materials is positioned past the rear face of the sled 10. The lay down actuator is fully retracted to fully pivot the pivoting arm 27 so as to move the lay down roller 22 out of the way of the spool. Generally, the movement of the spool from the intermediate position to the second position is a steady, quick, relative to the movement during the winding process, movement. At this point, the spool is removed from the support arms and a new core element inserted before the load and unload assembly is returned to the first position of FIG. 3A.

Figure 4A:
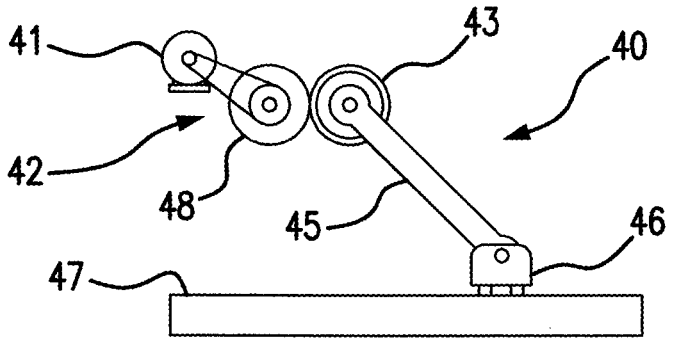
FIGS. 4A, 4B and 4C are sequential partial side views of an alternate embodiment of the winding apparatus according to the present teaching during operation.
Figure 4B:
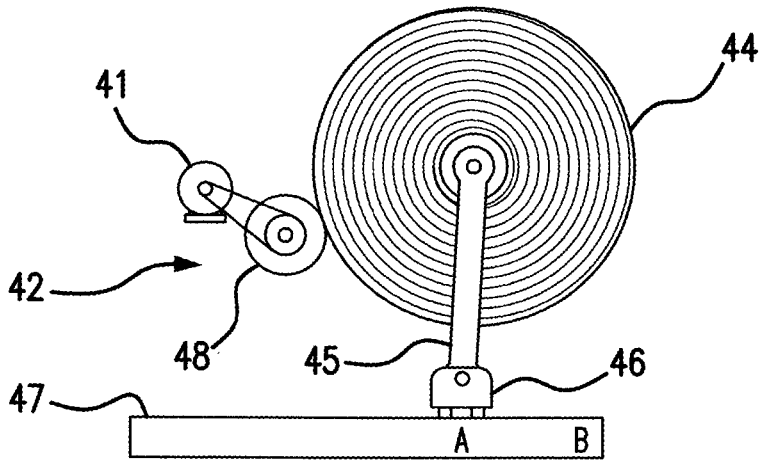
Figure 4C:
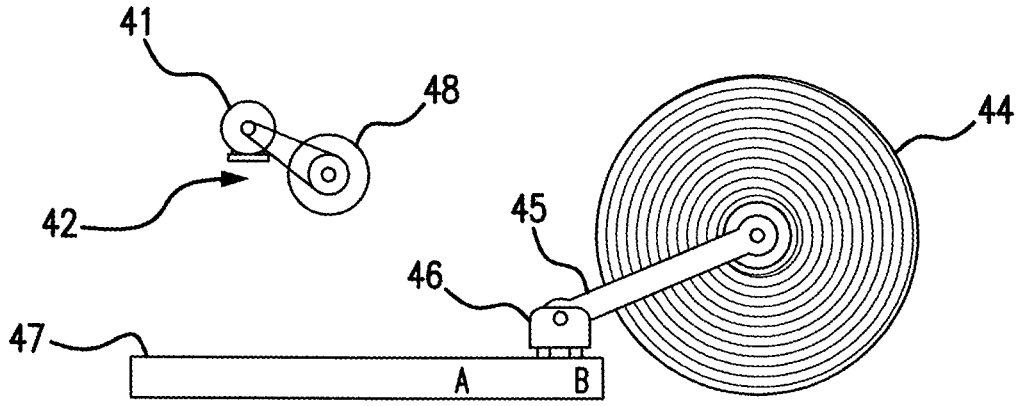

FIGS. 4A, 4B and 4C depict a simplified view of an alternative load and unload assembly 40 and drive motor assembly 42 through the same three stages of the winding process, as depicted in FIGS. 3A, 3B and 3C. In this embodiment, the lower ends of the spool support arms 45 are attached to a superstructure base element 46 which sits atop the sled 47. Again, the first position shown in FIG. 4A depicts the drive roller 48 driven by drive motor 41 biased against the core element 43. FIG. 4B depicts the intermediate position where the winding of the spool 44 is complete or nearly complete and the support arms have been moved from the first position to a position where the core of the spool is further removed from the drive roller. In this depiction the superstructure base element 46 includes a motor (not individually shown) that pivots the support arms 45, especially a motor associated with a cycloidal gearbox. However, it is to be appreciated that the superstructure base element could also be expanded to accommodate actuators as in FIG. 3A. Finally, FIG. 4C depicts the second position where the spool 44 is set to unload. Here, however, the superstructure base element has moved from a first point A to a second point B closer to the back edge of the sled 47 carrying with it the support arms and spool. This movement helps to ensure that the full spool 44 is pivoted away from the winding apparatus for ease of removal.

Figure 5A:
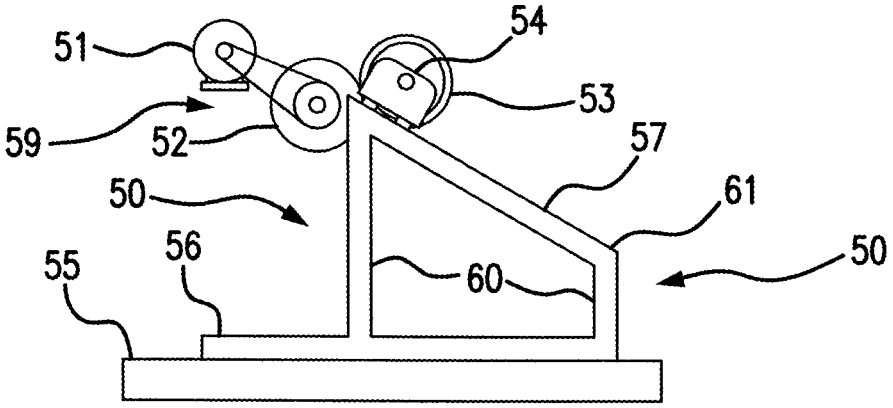
FIGS. 5A, 5B and 5C are sequential partial side views of a second alternate embodiment of the winding apparatus according to the present teaching during operation.
Figure 5B:
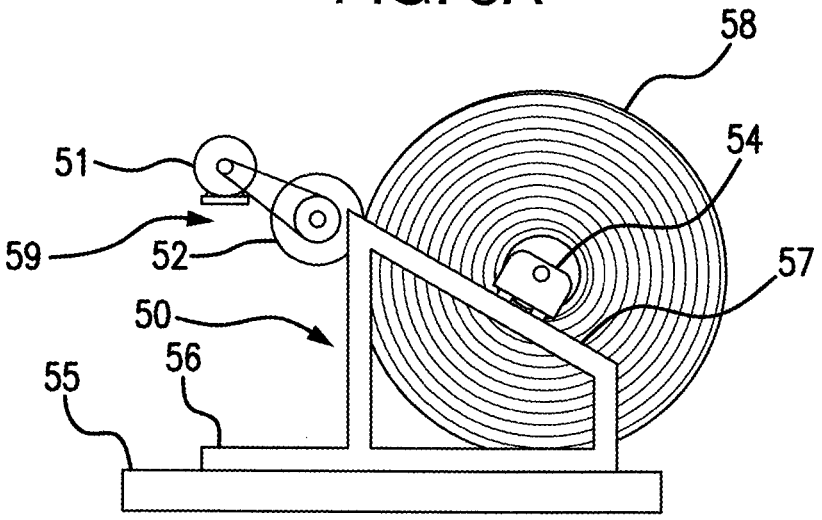
Figure 5C:
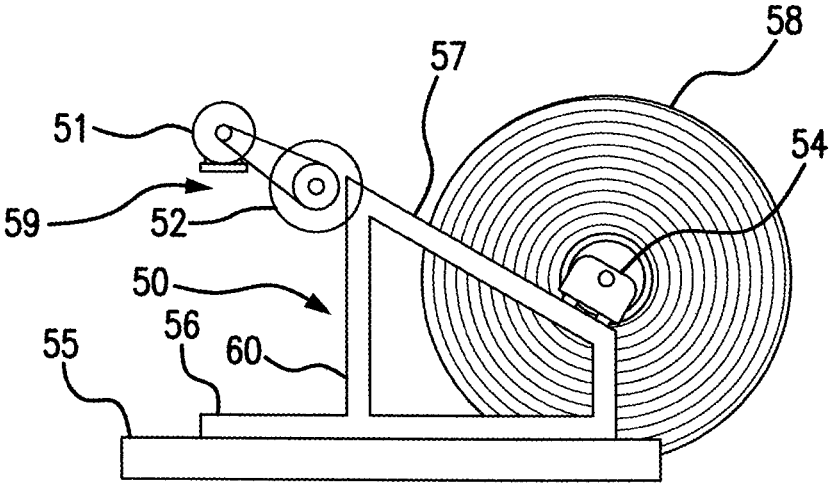

FIGS. 5A, 5B and 5C depict a simplified view of a second alternative load and unload assembly 50 and drive motor assembly 59 comprising a drive motor 51 and drive roller 52. The load and unload assembly comprises a pair of spaced railings 61 having a base rail 56 and a sloped top rail 57 and a pair of vertical support rails 60 atop the sled 55. The sloped top rail 57 has associated therewith a track (not shown) along which a motorized chuck assembly 54 traverses. The motorized chuck assemblies sit atop the sloped top rail and hold in place a core element 53 which is freely rotatable about the chuck. FIG. 5A shows the motorized chuck assembly 54 in a first position where the drive roller 52 is biased against the core element 53 and the core element is ready to accept the slit web material (not shown). FIG. 5B shows the motorized chuck assembly in an intermediate position where the winding of the web material 58 is complete or nearly complete. As indicated, the motorize chuck assembly gradually traverses the sloped top rail to accommodate the growing diameter of the spool of web material 58 whereas the drive motor assembly remains in place relative to its positioning with the railing 61. Finally, FIG. 5C depicts the motorized chuck assembly in the second position where the spool of web material 58 is ready for removal from the chuck assembly. Of course, all of this assembly is reciprocating along an axis that is perpendicular to the surface of the figure upon a carriage assembly (not shown).

Figure 6A:
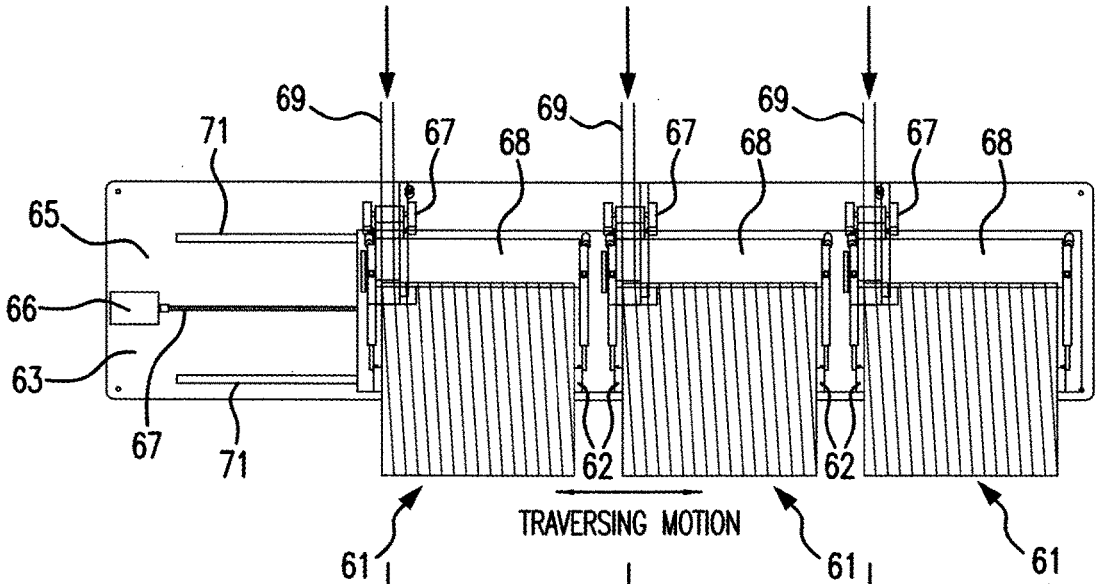
FIGS. 6A, 6B and 6C are sequential overhead views of a third alternate embodiment of the winding apparatus according to the present teaching during operation.
Figure 6B:
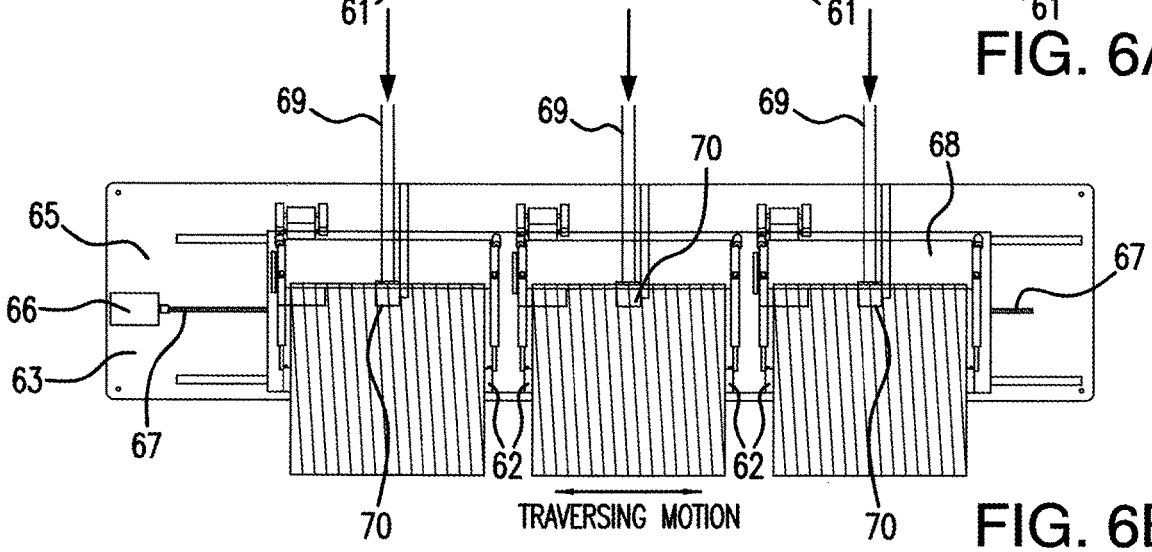
Figure 6C:
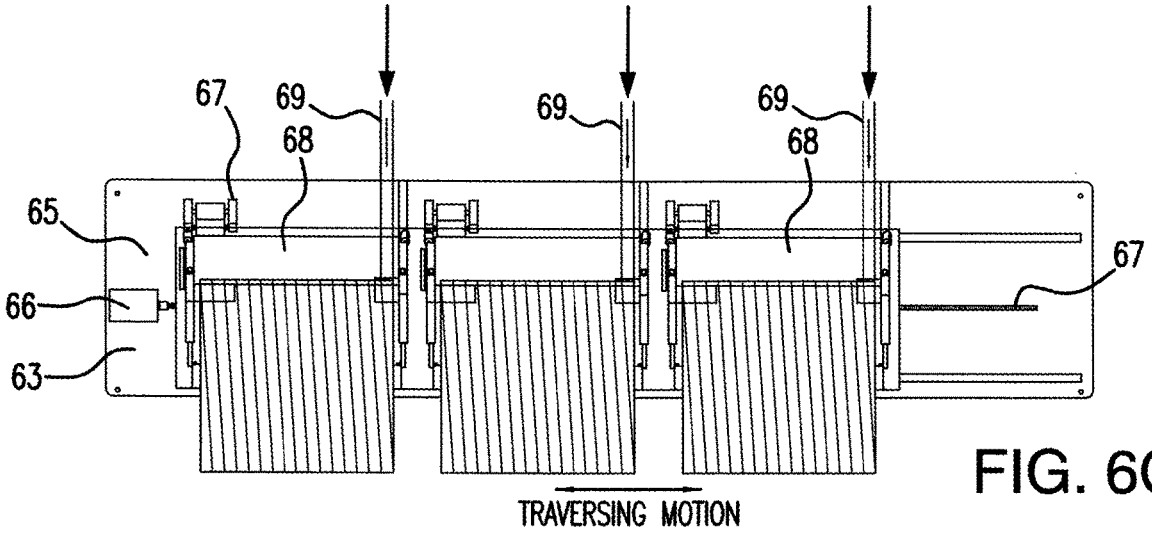

FIGS. 6A, 6B and 6C depict a preferred embodiment of the present teaching wherein a plurality, in this case three, winding assemblies, each on their own sled 62 (although it is to be appreciated that all three could be on a single sled), are seated atop a single platform 63. The platform 63 also has integrated therein a carriage drive assembly 65 comprising the carriage drive motor 66 and an axel or screw 67 which moves the sleds 62 along the major axis of the platform. The sleds ride along the rails 71 atop or integrated into the platform. As evident from these figures, the sleds move in unison in a traversing pattern back and forth across the platform along the major axis of the platform as the winding of the web material 69 continues. Concurrently, the spools 61 are rotated by the surface rotation action of the drive motor 67 and drive roller 68. Although these figures show a single platform with a plurality of winding apparatus, it is to be appreciated that the maximum value of the present teaching is the use of platforms having even more winding apparatus as well as a plurality of such platforms, each, preferably aligned parallel to and adjacent one another leaving enough space between the rear face of the platforms to allow for the spools to be unloaded and transported from the winding apparatus. Such an apparatus avoids the need for a superstructure to lift the spools from the cradles in the case of current surface wound spooling systems as well as the special requirements for core winding systems.

Figure 7:
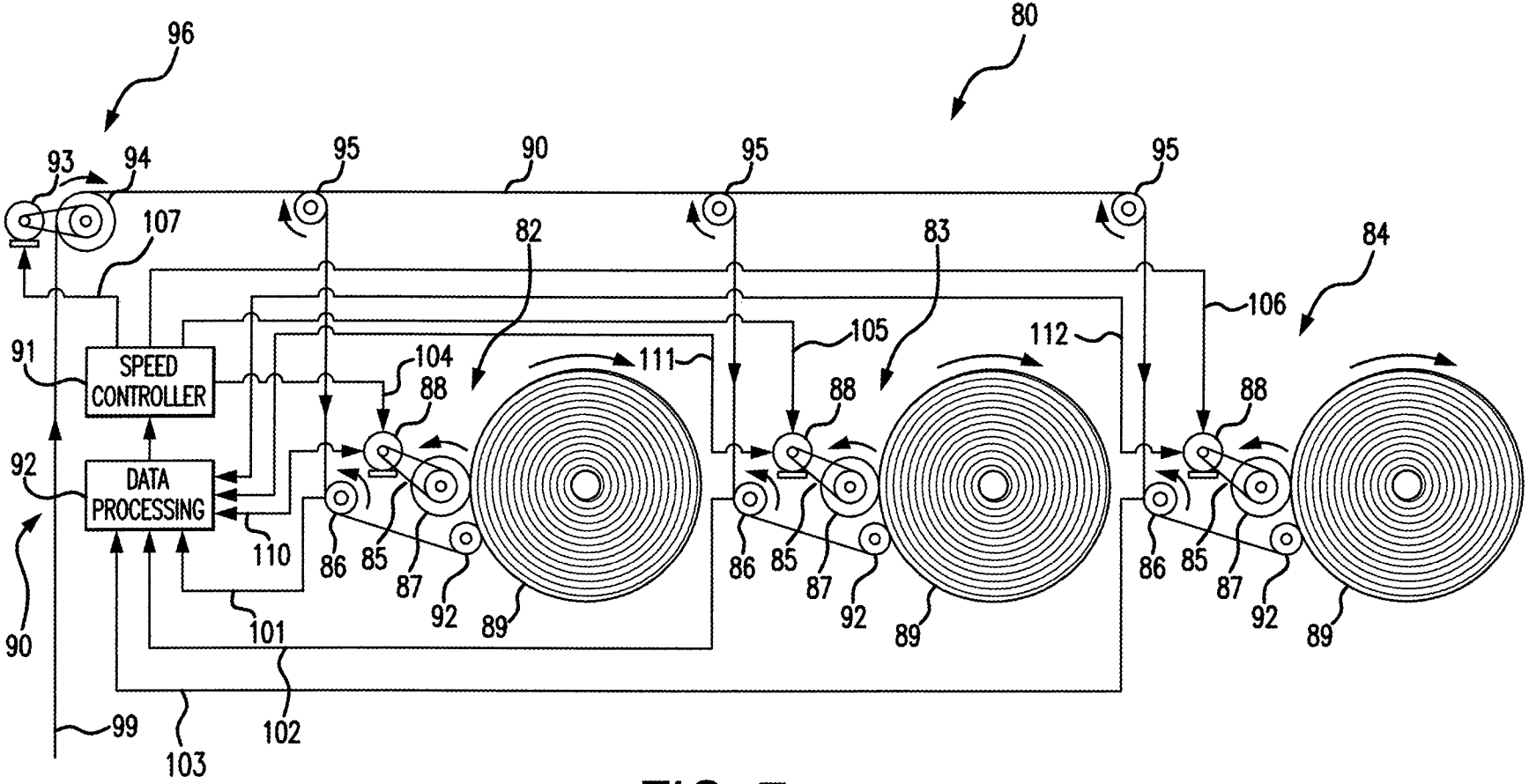
FIG. 7 is a partial side view of a fourth alternate embodiment of the winding apparatus according to the present teaching.

Finally, FIG. 7 shows a simplified side-view sketch of another alternative embodiment of a slit web winding system 80 wherein a plurality, in this case three, carriage assemblies (not shown) are aligned in a spaced parallel relationship, each comprising a plurality of winding assemblies 82, 83, 84 and a tension control system comprising a processor 90 having a data processing element 92 and a speed controller 91. Each of the winding assemblies comprises a drive motor assembly 85 comprising the drive motor 88 and a drive roller 87 for effecting the surface winding of the strip of web material 99 on the growing spool 89. In this instance the system comprises a web assist motor assembly 96 comprising a web assist motor 93 and web assist roller 94 for helping draw the strip of web material 99 to the winding apparatus. The apparatus further comprises a plurality of idler rollers 95 for directing each tow of slit web material to the proper winding apparatus. The lay down apparatus includes the tension sensing rollers 86 and the laydown rollers 92.

Each of the tension sensing rollers 86 detect the tension in the web and/or changes in the tension of the web as it approaches the spool 89 and sends that information to the data processor 92 via connections 101, 102, 103. Similarly, each of the drive motors 88 is in communication with the data processor as well, communicating the speed and performance thereof. The data processor is also in communication with each of the drive motors 88 via connections 110,

111, 112. The speed controller is also in communication with each of the drive motors 86 via connections 104, 105, 106 as well as with the assist motor 93 via connection 107. During operation, the data processing element receives information from the tension sensing rollers 86 and the drive motors 88 and, based upon that information, is able to detect whether the tension is too low or too high in each tow of web material and makes an adjustment to the drive motor, either increasing or decreasing its speed of rotation, of the affected winding assembly. Since each winding assembly is individually monitored and controlled, it is possible to maintain all tows of web material in a substantially constant tension.

Although not shown, a similar sensing and/or controlling system exists for the control of the actuators and other controlled elements of the lay down assembly and the load and unload assembly. For example, each of the actuators is likewise connected to an actuator controller and an actuator processor, the latter also being connected to a plurality of sensors associated with the laydown apparatus and the load and unload assembly to detect the changes in the diameter of the spool. As the spool size increases, the data is provided back to the actuator processor which then signals the actuator processor to effect the actuation of those actuators necessary to effect a movement of the spool from the first position to or towards the intermediate position: thereby accommodating the growth in the size of the spool. Alternatively, the processor may be preprogrammed to cause the automatic activation of certain actuators based on the calculated diameter of the winding spool, as mentioned above. Depending upon the system and the arrangement of the elements as well as the desired performance, the actuator processor may also cause the laydown system and the drive system to back away from the growing spool while maintaining the contact or tension of the lay down roller and drive rollers, as appropriate. Although this specific schematics are not shown for these iterations, those skilled in the art, having the benefit of the teachings herein will readily envision the control system associated therewith. Most preferably, the actuator control system and the tension control system for each carriage assembly is an integrated system with a single processor.

While the method and apparatus of the present specification have been described with respect to specific embodiments and figures, it should be appreciated that the present teachings are not limited thereto and other embodiments utilizing the concepts expressed herein are intended and contemplated without departing from the scope of the present teaching. Thus true scope of the present teachings is defined by the claimed elements and any and all modifications, variations, or equivalents that fall within the spirit and scope of the underlying principles set forth herein.

We claim:

1. An apparatus for traverse winding web materials in strip form comprising:

(a) a reciprocating carriage assembly, (b) a core load and unload assembly, (c) a tension controlled drive and lay down assembly, and (d) a control system wherein the reciprocating carriage assembly (a) comprises (a)(1) a stationary base having a length and width corresponding to a major axis and a minor axis, respectively, and an upper surface; (a)(2) a sled having a length and width corresponding to a major axis and a minor axis, respectively, parallel to the major and minor axes of the base, an upper surface, a front surface, a back surface, and an undercarriage, the front and back surfaces corresponding to the faces of the sled along and perpendicular to the minor axis of the sled, said sled set upon the surface of the base and adapted to move in an oscillating or reciprocating motion along the major axis of the base, and (a)(3) a carriage motor assembly for effecting the movement of the sled along the major axis of the base; the core load and unload assembly (b) comprises (b)(1) a superstructure mounted on or set upon the upper surface of the sled and adapted to receive and release a rotatable core element, said superstructure comprising or having (b)(2) parallel support railings or arms having upper and lower ends, the lower ends associated with the upper surface of the sled and the upper ends removed from or extending away from the upper surface of the sled, the railings or arms having (b)(3) opposing chuck elements at or near their upper ends for securely, yet releasably, receiving opposing ends of the core element whose axis, when mounted on the chucks, is parallel to the major axis of the sled, said chuck elements allowing for the free rotation of the core element about its axis, said railings or arms adapted to effect a movement of the core element along the minor axis of the sled from a first position intermediate the front and rear surfaces of the sled to a second position at or proximate to the rear surface of the sled, while maintaining the core element axis parallel to the major axis, the first position corresponding to the point at which winding of the flexible web material on the core element begins and the second position corresponding to the point where the core element is released from the chucks and the core load and unload assembly;

the tension controlled drive and lay down assembly (c) comprises (c)(1) a lay down assembly mounted on or co-stationary with respect to the stationary base forward of and removed from the front surface of the sled comprising a lay down roller element, whose axis is parallel to the major axis of the base, on a pivoting armature biased, in use, to be in contact with or proximate to, preferably biased to or against, the core element or the surface of the flexible web material as it is wound, (c)(2) a drive roller, whose axis is parallel to the major axis of the sled, aligned with and, in use, biased to be in contact with the core element or the surface of the flexible web material on the core element as it is being wound, the drive roller, effecting rotation of the core element through surface contact, and (c)(3) a drive motor for effecting rotation of the drive roller, the drive roller and drive motor being mounted on or set upon the sled intermediate the core element in its first position and the front face of the sled; and the control system comprises one or more sensors associated with the lay down assembly for detecting changes in the tension of the flexible web material and a processor for assessing the changes in the tension of the flexible web material and adjusting the speed of the drive motor to maintain a substantially constant tension in the flexible material.

2. The apparatus of claim 1 wherein the carriage motor assembly comprises a linear actuator.

3. The apparatus of claim 2 wherein the linear actuator is an oscillating linear actuator.

4. The apparatus of claim 1 wherein the stationary base comprises (a)(4) a pair of spaced, parallel rails aligned with the major axis of the sled and (a)(5) a plurality of rollers or wheels associated with the undercarriage of the sled which ride upon the rails in use.

5. The apparatus of claim 4 wherein the carriage motor assembly comprises a linear actuator.

6. The apparatus of claim 1 wherein the carriage motor assembly comprises an actuator motor, a worm or screw element driven by the actuator motor and a nut element which reciprocates along the worm or screw element.

7. The apparatus of claim 6 wherein the actuator motor and the worm or screw element are associated with or mounted on the stationary base and the nut element is associated with or mounted on the undercarriage of the sled.

8. The apparatus of claim 1 wherein movement of the sled along the major axis begins at a first point and ends at a second point with the distance between the two points generally corresponding to the length of the core element to be mounted on the chucks and the lay down roller is positioned such that it is opposite one end of the core element at the first point and opposite the other end of the core element at the second point.

9. The apparatus of claim 1 wherein a plurality of sleds are present on a single stationary base, each spaced from the other and aligned along the same major axis of the stationary base, and each associated with or carrying a core load and unload assembly and a tension control and lay down assembly.

10. The apparatus of claim 9 wherein the carriage motor assembly comprises an actuator motor and a worm or screw element, which worm or screw element is associated with a nut element associated with or mounted on the undercarriage of each sled.

11. The apparatus of claim 9 comprising a plurality of stationary bases, each having associated therewith or mounted thereon a plurality of sleds.

12. The apparatus of claim 11 wherein each stationary base has associated therewith a carriage motor assembly comprising an actuator motor and a worm or screw element, which worm or screw element is associated with a nut element associated with or mounted on the undercarriage of each sled.

13. The apparatus of claim 1 wherein the tension control device comprises a plurality of tension control roller elements and sensor elements associated therewith intermediate the source of the flexible material and the lay down roller, said plurality of tension control roller elements and the lay down roller defining a path for the flexible material through the winding apparatus to the core element.

14. The apparatus of claim 1 wherein the length and diameter of the drive roller are selected to be sufficient to effect rotation and stoppage of the core element, with or without the flexible material thereon.

15. The apparatus of claim 14 wherein the drive roller has a length that is about 50% to about 100% of the length of the core element to be placed on the apparatus and a diameter that is from about 10 cm to about 30 cm inches.

16. The apparatus of claim 1 wherein the drive motor is a variable speed motor.

17. The apparatus of claim 1 wherein the superstructure of the core load and unload assembly comprises parallel pivoting arms associated with at least one arm actuator for pivoting the ends of the arms from the first position to the second position.

18. The apparatus of claim 17 wherein an arm actuator is associated with each arm.

19. The apparatus of claim 17 wherein the pivoting arms are capable of opening and closing such that at least one end of one arm is able to move relative to the other, generally along the major axis, whereby upon opening the arms, they move away from each other to release or accept a core element and upon closing the arms, the move closer to each other to secure the core element.

20. The apparatus of claim 19 wherein one or more additional actuators effect movement of the arms in the major axis direction for opening and closing of the arms.

21. The apparatus of claim 19 wherein the arms are only capable of opening and closing when the core element is in the second position.

22. The apparatus of claim 17 where the arms automatically move away from each other as the core element approaches the second position.

23. The apparatus of claim 17 wherein the bases of the arms are pivotingly affixed to the sled.

24. The apparatus of claim 17 wherein the superstructure further comprises a hub element on the surface of the sled to which the bases of the arms are pivotingly affixed.

25. The apparatus of claim 24 wherein the hub is capable of movement along the minor axis of the sled from a point intermediate the front face and the rear face of the sled to a point at or nearer the rear face of the sled.

26. The apparatus of claim 25 wherein the arms open as the hub moves towards the rear face of the sled and closes as it moves back to its starting position.

27. The apparatus of claim 17 wherein the movement of the ends of the arms from the first position towards the second position coincides with the increasing diameter of the spool of flexible material on the core element.

28. The apparatus of claim 27 further comprising core element sensors to detect the increasing diameter of the wound flexible material which core element sensors directly or indirectly trigger the arm actuators to move the ends of the arms further toward the second position.

29. The apparatus of claim 28 wherein the core element sensors are associated with or integrated into the tension control system whereby a single processes controls all actions and actuators of the apparatus.

30. The apparatus of claim 1 wherein the superstructure comprises rails along whose top edges the chuck elements are capable of moving from the first position to the second position.

31. The apparatus of claim 30 wherein the rails are adapted to pivot relative to one another in the direction of the major axis so as to facilitate the insertion and removal of a core element from the chuck elements.

* * * * *